US005286294A

United States Patent [19]

Ebi et al.

[11] Patent Number: 5,286,294

[45] Date of Patent: Feb. 15, 1994

[54] VACUUM COATING APPARATUS

[75] Inventors: Tadamichi Ebi; Yoshihiko Imai, both of Nagoya, Japan

[73] Assignee: Gen Gen Corporation, Nagoya, Japan

[21] Appl. No.: 864,857

[22] Filed: Apr. 7, 1992

[30] Foreign Application Priority Data

Apr. 24, 1991 [JP] Japan ..... 3-122688

[51] Int. Cl.[5] ..... B05C 3/12

[52] U.S. Cl. ..... 118/667; 118/50; 118/63; 118/65; 118/405; 118/429

[58] Field of Search ..... 118/63, 65, 50, 666, 118/667, 405, 429

[56] References Cited

U.S. PATENT DOCUMENTS 4,258,656 3/1981 Hällgren ..... 118/666

FOREIGN PATENT DOCUMENTS 0151050 8/1985 European Pat. Off. .
0321693 6/1989 European Pat. Off. .
2015384 9/1979 United Kingdom .
2145442 3/1985 United Kingdom .

OTHER PUBLICATIONS

Patent Abstracts of Japan, vol. 6, No. 244 (C-138), Dec. 2, 1982, & JP-A-57-145-047, Sep. 7, 1982, Y. Koumura, et al., "Manufacturing of Metal-Coated Optical Fiber".

*Primary Examiner*—Matthew O. Savage
*Attorney, Agent, or Firm*—Oblon, Spivak, McClelland, Maier & Neustadt

[57] ABSTRACT

A vacuum coating apparatus for forming a thin film evenly coated over a material to be treated as well as providing excellent productivity. The vacuum coating apparatus includes a chamber, an evacuating device, a fluid supplier, a hood, and a gas reservoir. During operation, the chamber is subjected to a partial vacuum by the evacuating device and filled with treatment fluid. At this time, air at predetermined temperature supplied from the gas reservoir is admitted into the chamber. As a result, the temperature and viscosity of the treatment fluid in the chamber become constant. The material to be treated is then fed into the chamber via an inlet port and an outlet port. An air flow caused by evacuation removes excess fluid on the material at the outlet port, resulting in evenly forming a thin coating film.

9 Claims, 4 Drawing Sheets

VACUUM COATING APPARATUS

BACKGROUND OF THE INVENTION

1. Field of the Invention

The present invention relates to a vacuum coating apparatus for forming a thin layer coating film of treatment fluids such as paints over the surface of a material with a long body, i.e., wood, to be treated.

2. Description of the Prior Art

As a coating apparatus for forming the thin layer coating film over the material to be coated, a brush, spray, roll coater, curtain coater, dip coater, blade coater, and the like are well known. When applying treatment fluids over the material surface, however, such known apparatus often causes the mist or gas of the treatment fluid to scatter around. Moreover depending on the type of such coating apparatus in use, special skill for the fluid application is required.

In order to solve the above problem, a vacuum coating apparatus for wood treatment has been invented (GB2145442B). As FIG. 4 shows, the apparatus has a chamber 91 through which a material 8 is passed via an inlet port 911 and an outlet port 912, an evacuating device 92 by which the chamber 91 is subjected to a partial vacuum, and a fluid supplier 93 from which treatment fluid 7 is supplied to the chamber 91.

The material 8 is continuously fed into the chamber 91 through the inlet port 911 to be drawn out thereof through the outlet port 912. At this time, the chamber 91 is kept subjected to a partial vacuum by the evacuating device 92 so that the treatment fluid 7 is supplied into the chamber 91 from the fluid supplier 93. This causes air to flow into the chamber 91 via the clearances at the inlet port 911 and outlet port 912, resulting in an air flow 910 over the surface of the material 8. The air flow 910 removes excess fluid from the material 8 to have a thin layer coating film evenly formed over the surface thereof.

The apparatus of the above type is so constructed as to form the thin layer coating film over the material surface at high speed. The apparatus also prevents the fluid mist from scattering and requires no special skill for the fluid application. In FIG. 4, reference numerals 921, 922 designate exhaust passages, 931 and 94 designate a fluid passage, and roller guides, respectively.

With the apparatus of the known type, however, it is difficult to ensure to have the coating film thin and evenly applied over the material surface without lowering productivity and independent of the type of the treatment fluid in use, and change in the environmental temperature.

When treating the material, particularly wood, the thickness of the film to be coated thereon is often required to be 30 μm or less in order to accentuate its natural grain. For such a treatment, a substantially thin film is formed over the wood surface only without filling the naturally formed vessels in the wood with the fluid. In case of coating the film so as to have relatively a large thickness, cracks occur in the film surface. Or in such a case, processing, i.e., cutting and nailing, the wood that has been treated with the fluid might also cause the film to be cracked.

A thin film can be formed over the material surface by decreasing the speed for feeding the material in the chamber. This method, however, considerably decreases the level of productivity.

When using a paint either of water-based nature or ultraviolet curing type as the treatment fluid in an apparatus of the known type, a film with desired thickness cannot be obtained in spite of decreasing the feeding speed. In case of using the ultraviolet curing paint, the viscosity of oligomer, a component thereof, cannot be lowered easily, thus preventing a sufficient reduction of the viscosity of the paint. Generally as TABLE 2 set forth hereafter shows, the viscosity of the treatment fluid is likely to vary with the temperature. The treatment fluid thus should be kept a predetermined temperature during coating. In the known apparatus, since outside air is admitted into the chamber through the inlet port and outlet port, the temperature in the chamber is likely to vary with the outside air temperature. The temperatures in the chamber in summer and winter, or early in the morning and daytime, thus, become different. This change influences the viscosity of the fluid, preventing the thin layer coating film to be evenly formed over the material surface.

SUMMARY OF THE INVENTION

An object of the present invention is to provide a vacuum coating apparatus enabling the formation of a thin coating film having even thickness over the surface of a material with a long body and to increase productivity independent of the type of the treatment fluid and change in the environmental temperature.

A vacuum coating apparatus of the present invention includes a chamber provided with an inlet port and an outlet port through which a material to be treated is fed, an evacuating device for subjecting the chamber to a partial vacuum, a fluid supplier for supplying a treatment fluid to the chamber, a hood for covering the inlet port and outlet port of the chamber, and a gas reservoir for supplying gas at a constant temperature to the hood.

Other features and advantages of this invention will be apparent from the following description and the accompanying drawings.

PREFERRED EMBODIMENTS

The most salient feature of the present invention is to provide a hood and a gas reservoir with a vacuum coating apparatus, by which the gas at a predetermined temperature is admitted into a chamber to keep the viscosity of the treatment fluid therein constant.

The apparatus of the present invention is used for coating a long material such as a carbon shaft of a golf club and a construction material. The material may be formed of either wood, plastic, or carbon. The apparatus becomes the most efficient when it is used for coating the wood so as to accentuate its natural grain.

The above treatment fluids may be paints, stains, antiseptic agents, moth-proofing agents, adhesives, bleachers, or the mixture thereof. For example, the paints may be of either water-based nature, emulsion, or ultraviolet curing type.

The apparatus according to the present invention is advantageous in forming the thin layer coating film by means of those fluids, particularly, a water-based and solventless treatment fluids.

The above gas may be air or inert gas, such as nitrogen, argon, carbon dioxide gases, and a mixture thereof. A blower may be used as the evacuating device. As the gas reservoir for supplying the gas at predetermined temperature, it may be so constructed to supply cold or hot water controlled to a desired temperature from a cooling/heating device as a water temperature controlling device to a heat exchanger, by which the gas passing therethrough is kept at the desired temperature as FIG. 1 shows.

Preferably the gas reservoir is communicated with a temperature sensor so as to control the temperature of the gas reservoir based on the signal from the temperature sensor. This enables accurate adjustment of the treatment fluid temperature in the chamber.

Figure 1:
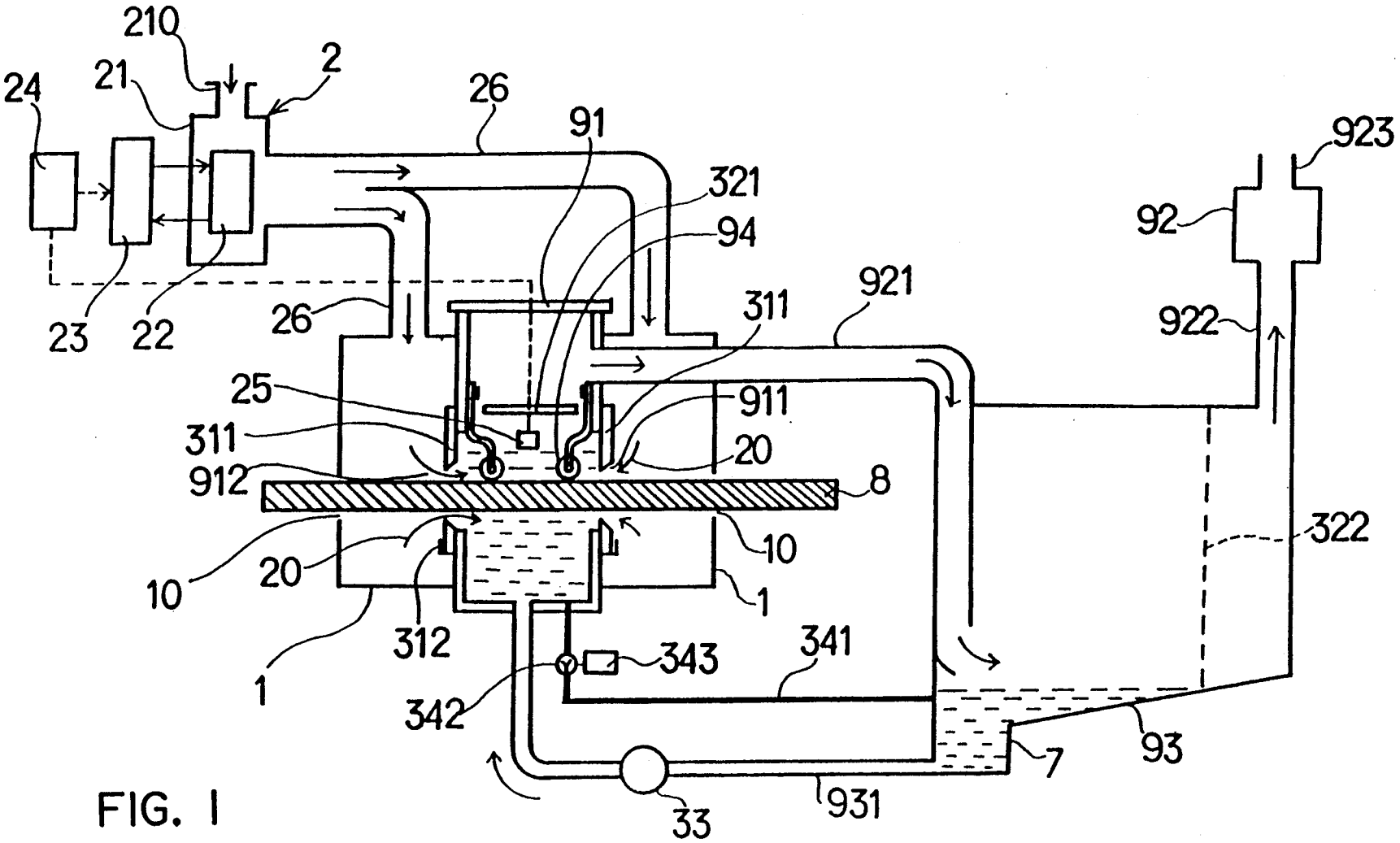
FIG. 1 is a schematic explanatory view of a first embodiment of a vacuum coating apparatus.
Figure 3:
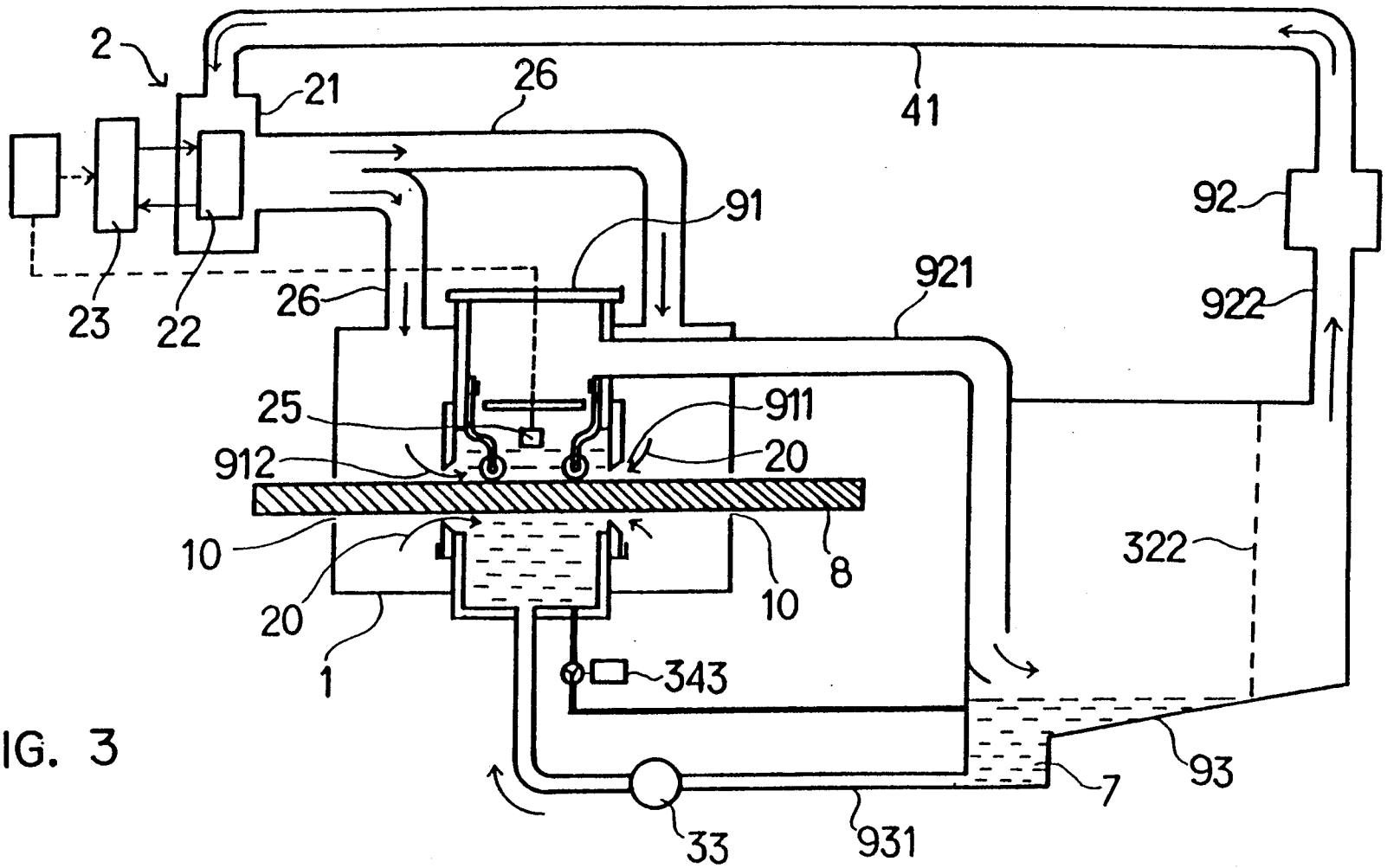
FIG. 3 is a schematic explanatory view of a second embodiment of the vacuum coating apparatus.
Figure 4:
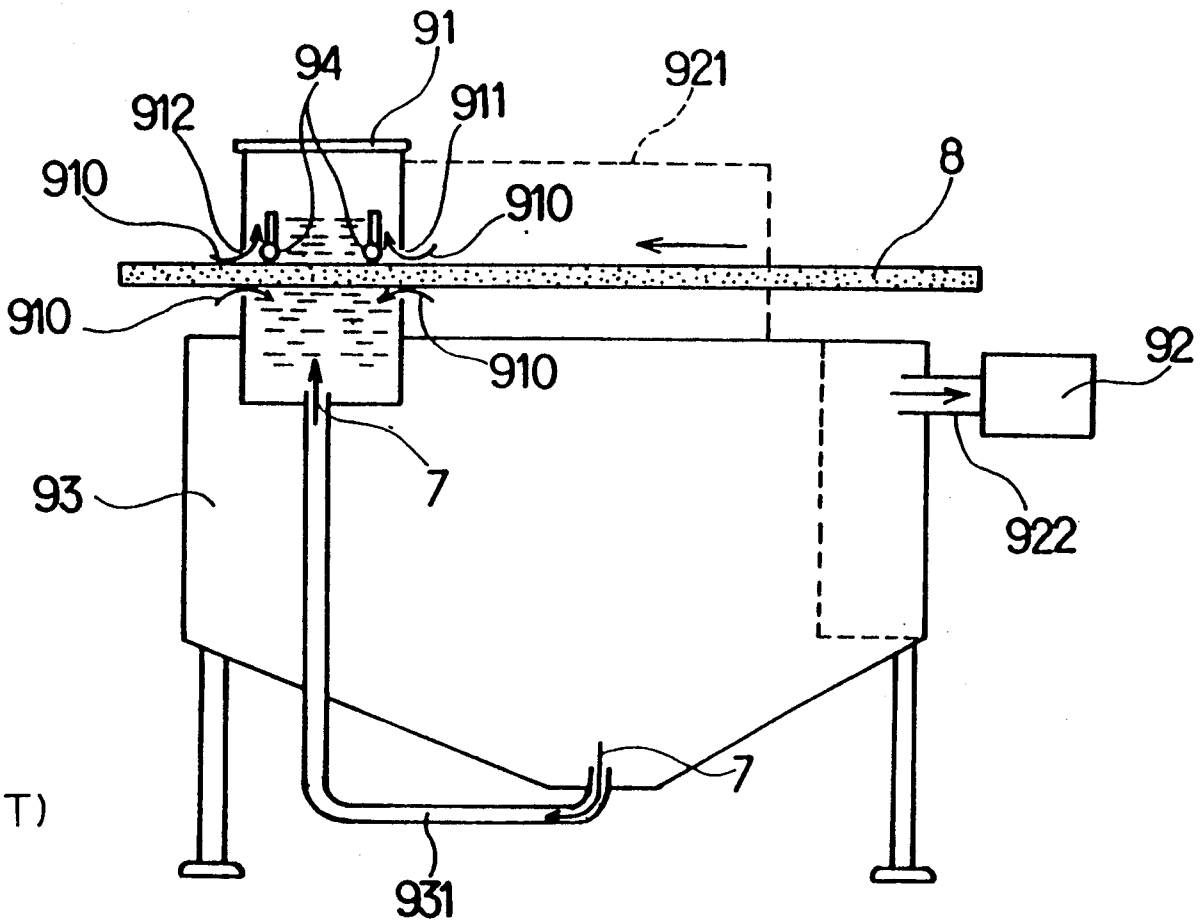
FIG. 4 (PRIOR ART)
FIG. 4 is a schematic explanatory view of a coating apparatus of a known type.

As FIG. 1 shows, as the first method for supplying the gas, unused gas is passed through the gas reservoir to be supplied to the hood. As FIG. 3 shows, as the second method, the gas that has been already used in the chamber is recycled to the gas reservoir from the evacuating device. Employing the second method enables reuse of the treatment fluid, solvent and heat, and prevention of the fluid and solvent leaking out.

In the present invention, when coating the material, the chamber is subjected to a partial vacuum by means of the evacuating device. Then the treatment fluid is supplied into the chamber from the fluid supplier, while the material to be treated is continuously fed into the inlet port of the chamber so as. The material passes through the chamber to leave from the outlet port thereof.

The treatment fluid is applied over the material surface when it passes through the chamber. The air is caused to flow into the chamber via the clearances between the inlet and outlet ports, and the material. The resulting air flow in the outlet port removes excess fluid from the material surface.

In the present invention, the gas at predetermined temperature is supplied from the gas reservoir to the hood. The gas within the hood is admitted into the chamber through the inlet port and outlet port, resulting in a predetermined temperature of the treatment fluid in the chamber. The predetermined temperature of the fluid leads to maintaining viscosity of the fluid constant. As a result, at the outlet port of the chamber, the apparatus provides the material treated with a substantially thin coating film that has been evened out. As aforementioned, since the viscosity of the treatment fluid is controlled by means of the gas at a constant predetermined temperature supplied from the gas reservoir, the speed for feeding the material can be increased as well as improving the productivity.

The present invention, thus, provides a vacuum coating apparatus enabling the formation of a substantially thin coating layer over the material to be treated regardless of the type of the treatment fluids, and the change in environmental temperature, resulting in improving the productivity.

EMBODIMENT 1

A vacuum coating apparatus according to a first embodiment of the present invention will now be described referring to FIGS. 1 and 2.

The vacuum coating apparatus of this embodiment includes a chamber 91 provided with an inlet port 911 and an outlet port 912 through which a material 8 passes, an evacuating device 92 for subjecting the chamber 91 to a continuous partial vacuum, a fluid supplier 93 from which treatment fluid 7 is supplied into the chamber 91, a hood 1 by which those inlet port 911 and outlet port 912 of the chamber 91 are enclosed, and a gas reservoir 2 from which the gas at predetermined temperature is supplied to the hood 1.

The hood 1 provided around the inlet port 911 and the outlet port 912 respectively defines openings 10 aligned with said inlet port 911 and said outlet port 912 as shown in FIG. 1 through which the material 8 is inserted. As FIG. 1 shows, the gas reservoir 2 is composed of a casing 21, a heat exchanger 22 enclosed in the casing 21, a cooling/heating device 23 as a water temperature controlling device for supplying either cold or hot water to the heat exchanger 22, and a controller 24 for controlling the cooling/heating device 23. The casing 21 has a hole 210 on its top for admitting the outside air. It is communicated with the upper part of the hood 1 via a gas passage 26. The cooling/heating device 23 has a heater and a refrigeration circuit for heating or cooling water so as to circulate either hot or cold water to the heat exchanger 22.

A controller 24 is connected to a temperature sensor 25 disposed within the chamber 91. The temperature sensor 25 detects the temperature of the treatment fluid 7 in the chamber 91. The controller 24 is so programmed to control the cooling/heating device 23 to set a desired temperature upon receiving the signal from the temperature sensor 25.

The chamber 91 is removably provided with templates 311 by means of a guide 312. Either the inlet port 911 or outlet port 912 has templates 311 formed therein. Each section of those inlet and outlet ports 911 and 912 is so shaped as to have the same section as, but a larger area than that of the material 8.

Figure 2:
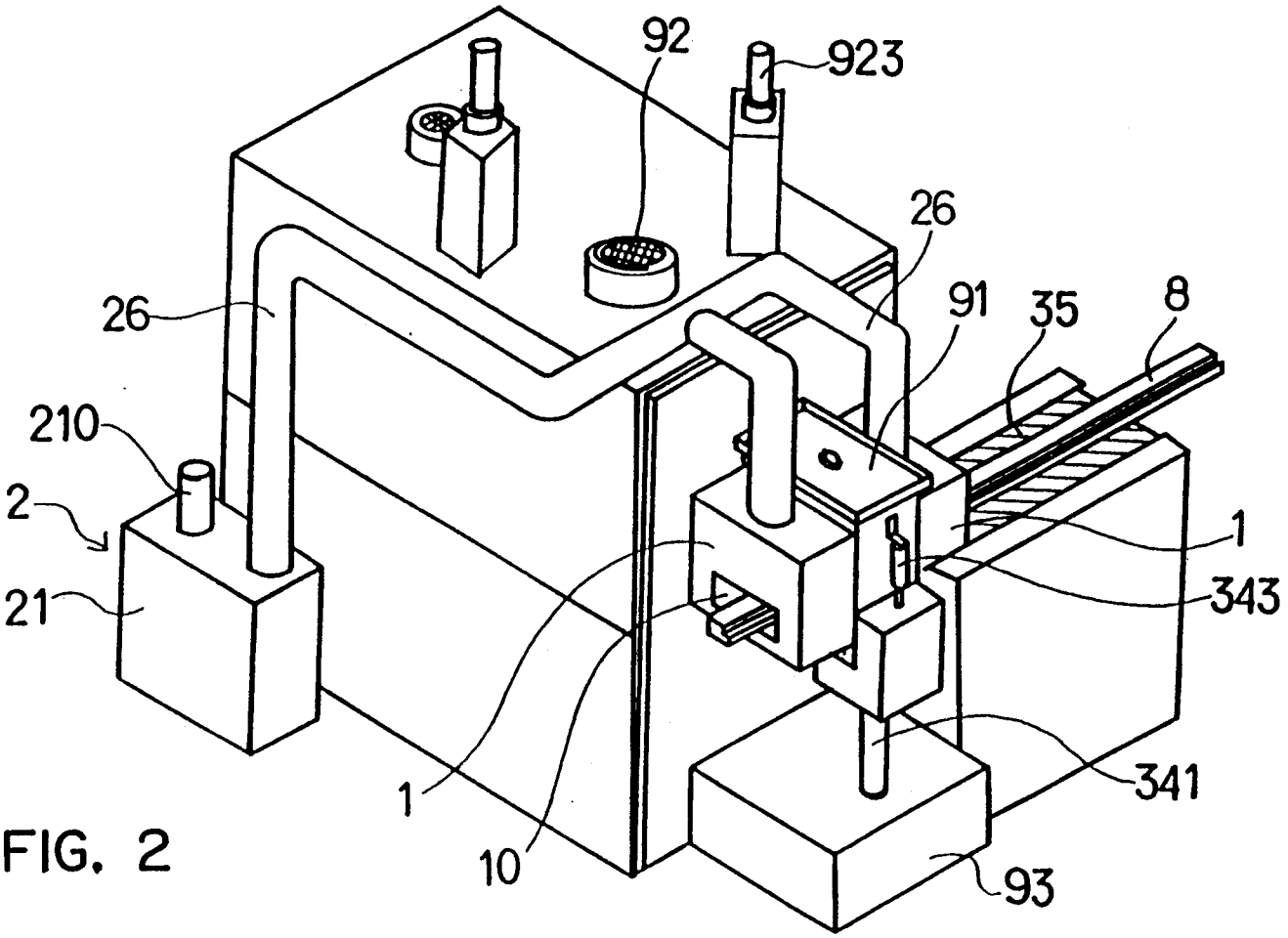
FIG. 2 is a perspective view of the first embodiment of the vacuum coating apparatus.

As FIGS. 1 and 2 show, the bottom part of the chamber 91 is communicated with the fluid supplier 93 via a drain pipe 341 provided with a valve 342. The valve 342 can be opened and closed by a cylinder 343 connected thereto.

In FIG. 1, reference numerals 321, 322, 33 and 923 designate a buffer plate, a baffle, a pump, and an exhaust port, respectively. In FIG. 2, reference numeral 35 designates a conveyer. Other constructions are the same as those of the known apparatus.

When applying the treatment fluids, the material 8 to be treated is ground on its surface. Then it is set on the conveyer 35. While the fluid supplier 93 is filled with the treatment fluid 7. In this embodiment, a paint is used as the treatment fluid 7.

The pressure in the chamber 91 is reduced down to be in the range of 50 to 150 mmHg by means of the evacuating device 92. The chamber 91 is continued to be subjected to a vacuum. The treatment fluid 7 is supplied into the chamber 91 from the fluid supplier 93, while the material 8 is continuously fed toward the inlet port 911 of the chamber 91.

The material 8 passes through the chamber 91 to exit out of the outlet port 912 of the chamber 91. The treatment fluid 7 is applied on the surface of the material 8 passing through the chamber 91. At this time, the air in the hood 1 flows into the chamber 91 via the clearance between the outlet port 912 and the material 8. The resulting air flow 20 removes excess fluid 7 from the surface of the material 8.

In this embodiment, the air flow 20 adjusted to be at a predetermined temperature is supplied into the hood 1 from the gas reservoir 2. The controller 24 of the gas reservoir 2 sends the control signal to the cooling/heating device 23 as a water temperature controlling device upon receiving the output signal of the temperature sensor 25 in the chamber 91. The cooling/heating device 23 supplies water controlled to be at a desired temperature into the heat exchanger 22 upon receiving the above control signal.

By this, the air in the casing 21 is controlled to a predetermined constant temperature, and sent into the hood 1 through the gas passage 26 to be admitted into the chamber 91 therefrom.

The treatment fluid 7 in the chamber 91, thus, has a predetermined constant temperature, resulting in constant viscosity. As a result, a substantially thin coating film with even thickness can be formed on the material 8.

Since the viscosity of the treatment fluid 7 can be controlled by means of the air at a predetermined temperature supplied from the gas reservoir 2, the thin coating film evenly coated can be formed on the material 8 independent of the type of the treatment fluid in use, and the change in the environmental temperature. This embodiment ensures the forming of a substantially thin coating film on the surface of the material 8. Particularly in case of coating wood, the apparatus according to the present invention is effective for accentuating its natural grain.

The thin coating film is formed by controlling the viscosity of the treatment fluid without decreasing the speed for feeding the material through the chamber, resulting in improving productivity. Repeating the above process step three times will effectively replace the conventional process steps of priming coating, brown coating, and skim coating.

EMBODIMENT 2

A vacuum coating apparatus according to this second embodiment will now be described referring to FIG. 3. In this embodiment, the casing 21 of the gas reservoir 2 and the evacuating device 92 described in EMBODIMENT 1 are connected via a gas circulation passage 41. Other constructions are the same as those of EMBODIMENT 1.

Since the apparatus of this embodiment is constructed as above, similar effects as those of EMBODIMENT 1 can be obtained. The air that has been already used in the chamber 91 is recycled to the gas reservoir 2 by means of the evacuating device 92 through the gas circulation passage 41. This enables reuse of the treatment fluid, solvent and heat, resulting in saving coating costs and preventing the fluid and solvent from leaking.

EMBODIMENT 3

This embodiment shows the test data of measurements conducted with respect to the relation between the temperature in the chamber and coating film thickness when using the vacuum coating apparatus according to the aforementioned EMBODIMENT 1. As TABLE 1 shows, the coating film thickness was measured at the respective temperature in the range of 20° to 40° C. For those measurements, an electromagnetic device for measuring the film thickness is used.

TABLE 1

| Temperature in chamber (°C.) | Film thickness (μm) |
|---|---|
| 20 | 26 |
| 25 | 23 |
| 30 | 19 |
| 35 | 17 |
| 40 | 16 |

As TABLE 2 shows, the viscosity of the treatment fluid was measured at the respective fluid temperature in the range of 15° to 50° C. For the paint, the ultraviolet curing urethane acrylic resin paint is used through Fordcup No. 4 measurement method.

TABLE 2

| Temperature (°C.) | Viscosity (S) |
|---|---|
| 15 | 75 |
| 20 | 58 |
| 25 | 45 |
| 30 | 36 |
| 35 | 29 |
| 40 | 24 |
| 45 | 20 |
| 50 | 18 |

As TABLE 1 shows, increasing the temperature in the chamber reduces the thickness of the coating film formed on the material surface. This is because, as TABLE 2 shows, the viscosity of the paint is gradually reduced as its temperature is increased. Those results show that a constant temperature in the chamber will keep the film thickness even. The thin coating film with a desired even thickness can be formed over the material surface by keeping a predetermined temperature in the chamber by means for the controller of a gas reservoir.

While the invention has been described with reference to the example, it is to be understood that modifications or variations may be easily made by a person of ordinary skill in the art without departing from the scope of this invention which is defined by the appended claims.

What is claimed is:

1. A vacuum coating apparatus comprising:

a chamber filled with a treatment liquid and provided with an inlet port and an outlet port through which a material to be treated is fed;

an evacuating device for subjecting said chamber to a partial vacuum;

a fluid supplier for supplying said treatment liquid to said chamber such that said treatment liquid is applied over a surface of the material as the material passes through said chamber;

a hood for covering said inlet port and outlet port of said chamber, said hood having an inlet and outlet opening aligned with said inlet port and outlet port of said chamber for passing said material therethrough;

a feeder for feeding said material through said inlet and outlet openings in said hood and said inlet and outlet parts of said chamber; and a gas reservoir having a gas temperature controller device for supplying gas at a substantially constant predetermined temperature to said hood and maintaining the viscosity of said treatment liquid substantially constant independent of a change of environmental temperature surrounding said hood wherein said vacuum in said chamber and the gas supply to said hood causes an air flow over the material such that excess liquid on said material is removed.

2. A vacuum coating apparatus according to claim 1, wherein said gas temperature controller device includes a heat exchanger located in said gas reservoir for performing one of heating and cooling of the gas to be supplied to said hood.

3. A vacuum coating apparatus according to claim 2, wherein said gas temperature controller device has a temperature sensor for detecting the temperature of said treatment liquid in said chamber.

4. A vacuum coating apparatus according to claim 1, wherein said gas temperature controller device includes a heat exchanger and a device for supplying water controlled to be at a desired temperature into said heat exchanger.

5. A vacuum coating apparatus according to claim 1, wherein a recirculation passage is defined between said evacuating device and said gas reservoir.

6. A vacuum coating apparatus according to claim 1, wherein said chamber has templates at said inlet port and outlet port through which said material is fed, and said templates have openings through which said material is fed with their cross sections substantially similarly shaped to that of said material but of a larger size for allowing passing of said material therethrough.

7. A vacuum coating apparatus comprising:

a chamber filled with a treating liquid and provided with an inlet port and an outlet port through which a material to be treated is fed;

an evacuating device for subjecting said chamber to a partial vacuum;

a fluid supplier for supplying said treatment liquid to said chamber such that said treatment liquid is applied to a surface of the material as the material passes through said chamber;

a hood for covering said inlet port and said outlet port of said chamber, said hood having an inlet and outlet opening aligned with said inlet port and said outlet port, respectively, of said chamber for passing material therethrough; and a feeder for feeding gas into said chamber, said feeder including a heat exchanger for heating or cooling said gas, a temperature sensor for sensing the temperature of said treatment liquid in said chamber, and a controller responsive to said temperature sensor to maintain said treatment liquid at a predetermined temperature, wherein said feeder supplies gas at a predetermined temperature to said hood to maintain the viscosity of said treatment liquid substantially constant independent of a change in environmental temperature surrounding said hood, and wherein said vacuum in said chamber and the gas supply to said hood causes air flow over the material such that excess liquid on said material is removed.

8. A vacuum coating apparatus according to claim 7, wherein said heat exchanger comprises a water to gas heat exchanger and means responsive to said controller means for supplying water at a predetermined temperature into said heat exchanger.

9. A vacuum coating apparatus according to claim 7, wherein a recirculation passage is defined between said evacuating device and said feeder.

* * * * *